United States Patent [19]

Yamaguchi

[11] Patent Number: 5,007,119

[45] Date of Patent: Apr. 16, 1991

[54] INFANT'S CHAIR FOR SHAMPOOING

[75] Inventor: Sumiko Yamaguchi, Shizuoka, Japan

[73] Assignees: Sumiko Yamaguchi; Tomohiro Shirakawa, both of Fuji, Japan

[21] Appl. No.: 319,872

[22] Filed: Mar. 1, 1989

Related U.S. Application Data

[63] Continuation of Ser. No. 637,602, Aug. 3, 1984, abandoned.

[30] Foreign Application Priority Data

Aug. 11, 1983 [JP] Japan ..... 58-145632
Sep. 29, 1983 [JP] Japan ..... 58-149613

[51] Int. Cl.[5] ..... A45D 44/02
[52] U.S. Cl. ..... 4/523; 4/572
[58] Field of Search ..... 4/515–517, 4/519, 523, 572; 297/182, 250, 460, 464; 5/432, 433

[56] References Cited

U.S. PATENT DOCUMENTS

| | | | |
|---|---|---|---|
| D. 266,940 | 11/1982 | Roslan | 4/572 X |
| 2,281,629 | 5/1942 | Snow | 4/572 X |
| 2,697,480 | 12/1954 | Du Bois et al. | 4/572 X |
| 3,086,222 | 4/1963 | Hall et al. | 4/572 X |
| 3,428,361 | 2/1969 | Reynolds | 4/523 X |
| 3,505,691 | 4/1970 | Reynolds et al. | 4/517 |
| 3,545,016 | 12/1970 | Schorken | 4/572 X |
| 3,633,222 | 1/1972 | Greenfield | 4/517 |
| 3,957,303 | 5/1976 | Mauron | 297/250 X |
| 3,964,787 | 6/1976 | Labadie et al. | 297/250 X |
| 4,266,306 | 5/1981 | Lee | 4/572 |

*Primary Examiner*—Charles E. Phillips
*Attorney, Agent, or Firm*—Schwartz & Weinrieb

[57] ABSTRACT

An infant's chair which provides safe confinement of an infant while the infant is being shampooed comprises a smoothly depressed seat part formed on the upper side of a chair proper and two back parts of dissimilar lengths obliquely extended upwardly from the opposite ends of the seat part. The upper end of either of the back parts receives the back of the infants's neck when he is laid on his back with his buttocks mounted on the seat part and his back stretched over the back part.

13 Claims, 2 Drawing Sheets

INFANT'S CHAIR FOR SHAMPOOING

This application is a continuation of application Ser. No. 637,602, filed Aug. 3, 1984 now abandoned.

BACKGROUND OF THE INVENTION

1. Field of the Invention

This invention relates to a chair for seating an infant in a posture suitable for shampooing the infant by a bathtub.

2. Description of Prior Art

When a mother bathing her infant shampoos him, she cradles him on her lap, holds his head in one hand, and washes his hair with the other hand. When the infant is no older than one year or so, she has no difficulty because he rarely moves and remains quiet. When the infant is older than two years, he hates to remain long in one posture, with his head held up in his mother's hand, and soon starts struggling for freedom from his mother's grip. The mother then finds the work of shampooing difficult. There are times when the shampoo or the bath water gets into his eyes or ears, things which make him abhor being shampooed.

To alleviate the situation, there has been proposed an infant's chair for shampooing, so constructed that the back of the infant's neck is supported on the upper end of the back of the chair when he is laid on his back on the chair with his buttocks seated on the bottom thereof and his back stretched over the chair back (Japanese Utility Model Application Disclosure SHO No. 50(1975)-42963).

The mother finds this chair very convenient because she is now free to use both her hands in washing the infant's head which protrudes from the top of the chair back. But infants grow fast, and the day soon arrives when not only his head but also his shoulders will protrude from the top of the chair back and, consequently, he will no longer lie stably on the chair. It is not impossible that when he moves his body suddenly while his mother is busy with the shampooing, the chair will overturn and he will be thrown out onto the floor. This danger may be avoided by procuring increasingly large chairs to keep pace with his growth. This practice, however, is unfeasible from the economic point of view.

OBJECT OF THE INVENTION

An object of this invention is to provide an infant's chair for shampooing, so constructed that the top portion thereof may be extended in proportion to the growth of the infant's height to ensure stable confinement of his body during the shampooing.

SUMMARY OF THE INVENTION

The infant's chair for shampooing provided by this invention comprises a smoothly depressed seat part formed on the upper side of a chair proper and two back parts of dissimilar lengths extended obliquely upwardly from the opposite ends of the seat part, so that when an infant is laid on his back on either of the two back parts with his buttocks mounted on the seat part and his back stretched over the back part, the back of his neck is received on the upper end of the back part. In one aspect of this invention, this chair may be designed so that the seat part and the back parts will be fabricated separately of each other to be readily assembled afterward. In this chair, the back parts can be readily replaced with increasingly large back parts to follow the growth of the infant's height.

BRIEF DESCRIPTION OF THE DRAWINGS

Other objects and characteristics of this invention will become apparent from the further disclosure of this invention to be made in the following detailed description of a preferred embodiment, with reference to the accompanying drawings wherein.

DESCRIPTION OF PREFERRED EMBODIMENTS

Figure 1:
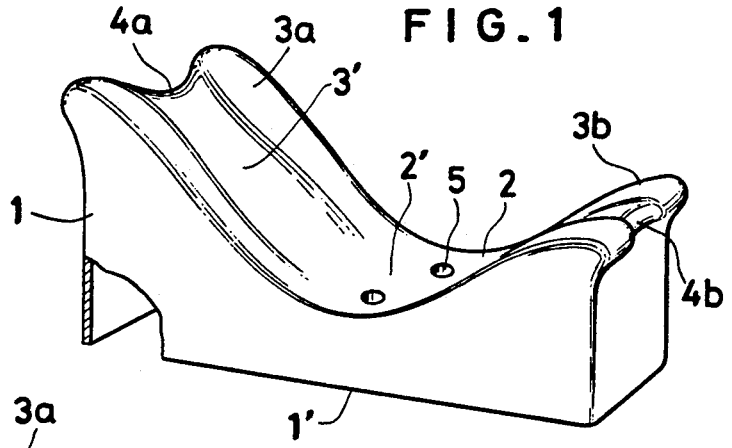
FIG. 1 is a perspective view illustrating a first embodiment of an infant's chair for shampooing according to this invention.

FIG. 1 represents a first embodiment of the infant's chair for shampooing according to this invention. In the diagram, 1 denotes a chair proper possessing a bottom edge 1'defining a horizontal surface. A smoothly depressed seat part 2 adapted to receive an infant's buttocks is formed on the upper side of the chair proper. Two back parts **3*a*, 3*b* of dissimilar lengths are obliquely extended upwardly from the opposite ends of the seat part 2. The back parts 3*a*, 3*b* are provided respectively at the upper ends thereof with hollows 4*a*, 4*b* formed by a concavity centered with respect to the respective back part and extending upwardly toward either end of the chair so as to be adapted to provide stable support to the back of the infant's neck when he is laid on his back in the chair with his buttocks mounted on the seat part and his back stretched over the back part. The distance between the seat part and the hollow 4*a* at the upper end of one of the back parts is so fixed that when an infant of 2 to 3 years of age is laid on his back on the chair with his buttocks mounted on the seat part, only his head protrudes from the hollow 4*a*. The distance from the seat part to the hollow 4*b* at the upper end of the other back part is so fixed that an infant of up to 1 year of age can have his head protruding from the hollow 4*b***. The angle of inclination of each of the back parts and the height of each of the back parts are selected in due consideration of the safety of the infant seated on the chair and the ease of shampooing.

The central portions 2', 3' in the longitudinal direction of the seat part and the back parts may be slightly depressed so as to contain the infant's body inwardly from the lateral edges. A venthole 5 is bored in the lowest portion of the seat part 2.

As is noted from the partially cutaway view of FIG. 1, the chair may be molded of plastic in a hollow form. Of course, it may be molded of foam plastic in a solid form. Otherwise, it may be a bag of synthetic resin film such that it will form the chair of this invention when inflated with air.

To use this chair, the infant is laid on his back with his buttocks mounted on the depressed seat part 2, and his back stretched over either the back part 3*a* or the back part 3*b*, depending on his height, the back of his neck being supported on the hollow 4*a* or 4*b* at the upper end of the back part, and his head protruding out of the upper end of the back part. Consequently, the infant's body is snugly confined in the chair with his buttocks stably supported on the seat part 2. The mother, therefore, can use one hand to keep his eyes and ears from entry of shampoo or bath water and the other hand to wash his hair.

As described above, in the embodiment of FIG. 1, the chair has two back parts 3*a*, 3*b* of dissimilar lengths provided at both ends Of the seat part 2. Thus, the back part 3*b* of a smaller length is used for an infant of 1 to 2 years of age and the back part 3*a* of a larger length for an older infant. Thus, this chair is adapted to keep pace with the growth of the infant and, accordingly, permits long use. In one and the same chair, the mother can shampoo an older child on the taller back part or a younger child on the shorter back part.

Figure 2:
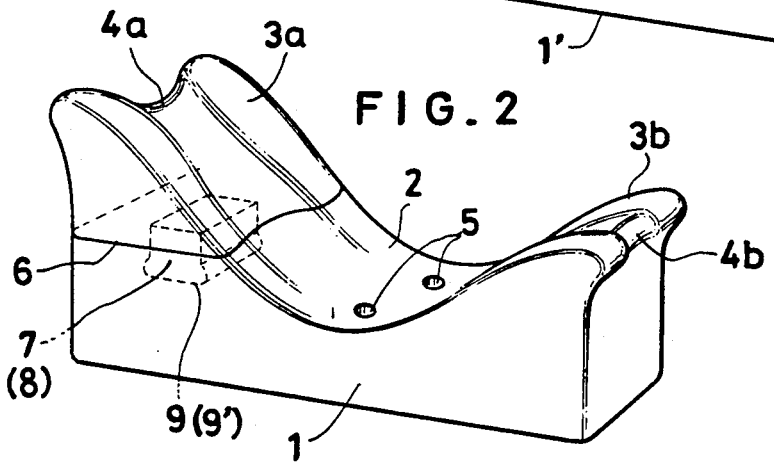
FIG. 2 is a perspective view illustrating a second embodiment of an infant's chair for shampooing according to this invention.

FIG. 2 represents a second embodiment of this invention. The infant's chair for shampooing in this embodiment is so constructed that at least one of two back parts 3*a*, 3*b* is fabricated separately of the seat part 2 and the remaining back part and it is afterward joined to the seat part 2 as illustrated. In the embodiment illustrated, the back part 3*a* constitutes the separable section of the chair. A joining plane 6 lies horizontally. The joining face of the seat part 2 and that of the back part 3*a* are congruent with each other. Accurate alignment and union of the two joining faces are obtained in this embodiment by the cooperation between a protuberance 7 formed at the center of the joining face of the back part 3*a* and a depression 8 formed at the center of the joining face of the seat part 2 so as to receive the protuberance 7. The attachment and detachment of the back part 3*a*, therefore, can be readily accomplished by simply inserting the protuberance 7 into the depression 8.

The back part 3*a* is available in a plurality of lengths and heights. All these back parts 3*a*, 3*a*', 3*a*'', however, have their joining face 6 and protuberance 7 formed in uniform dimensions. Thus, any of these back parts can be joined with the seat part 2 as indicated by the chain lines in FIG. 3, to complete a chair having a back part of the desired shape. The protuberance 7 is provided at the leading end thereof with a swelled portion 9 and the depression 8 is provided at the bottom thereof with a concave portion 9' adapted to accommodate the aforementioned swelled portion 9. In this arrangement, the seat part 3*a* once joined to the seat part 2 will not readily come off.

Figure 4:
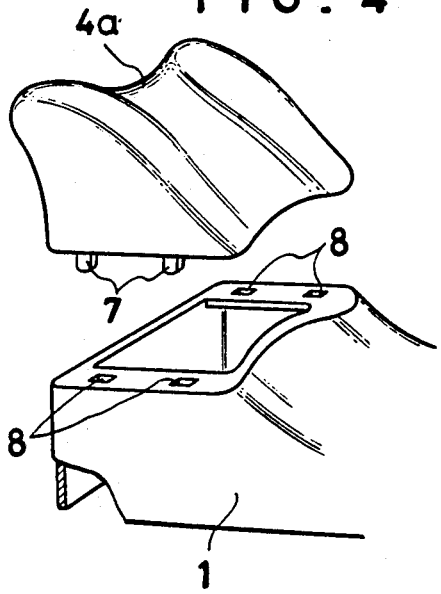
FIG. 4 is an explanatory diagram illustrating another embodiment of a joint part of the chair.
Figure 3:
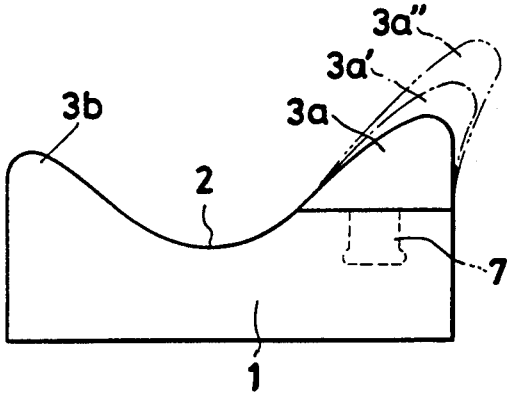
FIG. 3 is a front view of the chair of FIG. 2.

FIG. 2 and FIG. 3 represent embodiments in which the seat part 2 and the back part are wholly molded of foam resin, for example. When these parts are formed not in a solid form but in a hollow form composed solely of shells of resin, protuberances 7 and depressions 8 are formed one each at the four corners as illustrated in FIG. 4. Any of other known devices may be adopted for the alignment and union of these protuberances 7 and depressions 8.

Figure 5:
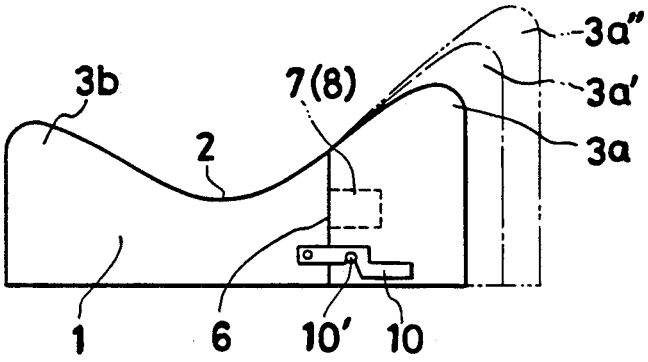
FIG. 5 is a front view illustrating a modification to the chair of the second embodiment.

The boundary in which the seat part 2 and the back part 3*a* are joined and separated is not limited to the horizontal plane 6 used in the embodiments of FIG. 2 and FIG. 3. FIG. 5 represents an embodiment in which the joining plane 6 is formed vertically and the back part 3*a* is extended downwardly so as to rest directly on the same level as the seat part 2. In this case, a protuberance 7 is formed on the joining face 6 of the seat part 2 and a depression 8 is formed on the back part side so as to permit accurate alignment and union of the seat part and the back part 3*a*. Further, hooks 10 and matched snaps 10' are formed one each on the opposite lateral faces of the chair proper and the back part. The leading ends, forming handle parts, of the hooks 10 pivotally supported on the seat part 2 side are pushed down until the snaps 10' on the back part 3*a* side enter the engaging positions of the hooks and, then the hooks are brought into engagement with the snaps. Consequently, the seat part 2 and the back part 3*a* are tightly united along the joining plane 6.

Figure 6:
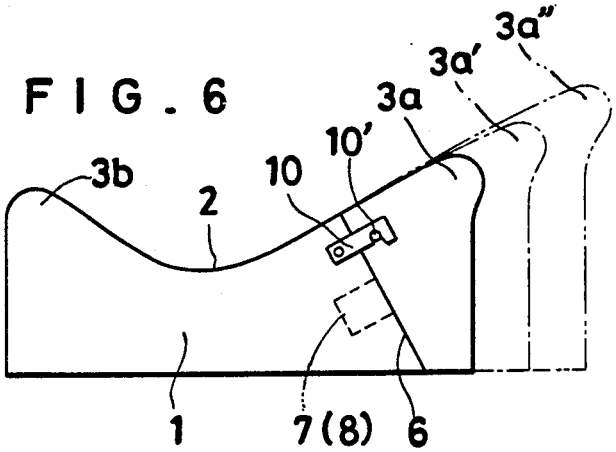
FIG. 6 is a front view illustrating yet another modification to the chair of the second embodiment.

The joining plane 6 is not always required to lie horizontally or vertically as described above. It may lie obliquely as illustrated in FIG. 6. The devices used in this case for fast union are similar to those of FIG. 5, except that the hooks 10 lack handle parts.

In any of the various embodiments described above, the back portion is made available in varying sizes (3*a*', 3*a*'', . . . ) which may be suitably selected and fitted so as to keep pace with the increase in the infant's height. Thus, the chair ensures safe confinement of the infant's body.

Figure 7:
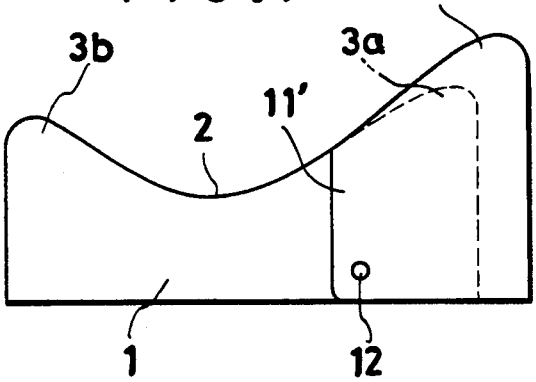
FIG. 7 is a front view illustrating the third embodiment of a chair of this invention.
Figure 8:
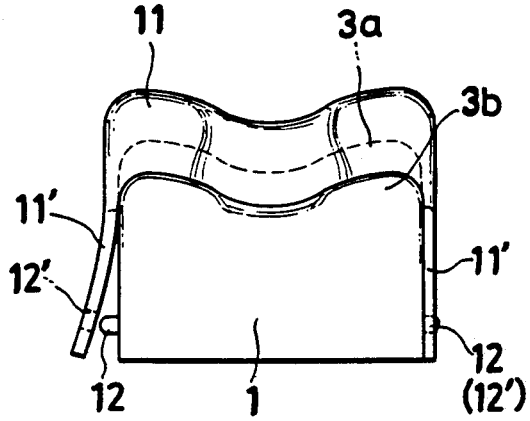
FIG. 8 is a side view of the chair of FIG. 7.

FIG. 7 and FIG. 8 represent a third embodiment of this invention. The infant's chair for shampooing in this embodiment is so constructed that, when the chair of FIG. 1 is outgrown by the infant and, consequently, the back part 3*a* thereof is no longer capable of safely accommodating the infant's back, a larger hollow back part 11 which is separately prepared will be fitted tightly on the back part 3*a*. The shape of the hollow space in the back part 11 is congruent with the shape of the back part 3*a*. Side walls 11' of the back part 11 which are adapted to nip the opposite lateral walls of the back part 3*a* are provided with holes 12' for admitting pins 12 which are projected from the chair proper 1. After the back part 11 has been completely draped over the back part 3*a*, the pins 12 are inserted into the holes 12' by taking advantage of the resiliency of the lateral walls 11' to complete the union of the chair proper 1 and the back part 11.

In this embodiment, when the chair is outgrown by the infant, the larger back part can be slipped over the previously used back part to enable the chair to keep pace with the growth of the child. Thus, the chair is enabled to provide safe confinement of the infant in spite of the infant's growth.

Since the infant's chair of this invention possesses back parts of dissimilar length, such back parts may be selected appropriately to keep pace with the infant's growth. It is economical in respect that the one and the same chair, therefore, can give protracted service. By the selection of the suitable length of the back part, this chair continues to provide safe confinement of the infant's body during shampooing.

The chair of this invention can serve as a staple item in a household bathroom, a public bath house, or a hot-bath resort, for example, to permit ready use for shampooing infants. Infants will find shampooing quite comfortable and enjoyable in the chair of this invention.

Obviously, many modifications and variations of the present invention are possible in light of the above teachings. It is therefore to be understood that within the scope of the appended claims, the present invention may be practiced otherwise than as specifically described herein.

What is claimed is:

1. A chair for supporting varying sizes of infants during a shampooing operation, comprising:

a base portion having a bottom horizontal surface for placement upon a support surface, and an upper infant supporting surface having opposite ends and opposite lateral edges;

said infant supporting surface comprising a smoothly depressed concave seating portion adapted to receive an infant's buttocks, and first and second back supporting portions extending upwardly from opposite ends of said seating portion for alternatively supporting an infant's back, said back supporting portions being of dissimilar length and each being provided at its upper end with a hollow adapted to support the back of an infant's neck while said infant's buttocks are supported by said seating portion and said infant's back is supported by one of said back supporting portions;

each one of said hollows being formed by a concavity centered with respect to its respective back supporting portion, said concavity extending upwardly toward a respective one of said opposite ends of said infant supporting surface;

said seating portion defined a continuously smooth concave curvature extending between said opposite lateral edges of said infant supporting surface;

said first back supporting portion including an inclined surface extending upwardly in a first direction at a first predetermined angle with respect to said concave seating portion from one end of said smoothly depressed concave seating portion of said chair toward one end of said chair and having a first predetermined length for stably supporting the torso portion of a first infant's body, having a first length dimension, as defined between the buttocks of said first infant and the neck of said first infant, which is characteristic of an average sized child within the range of 2–3 years of age; and said second back supporting portion including an inclined surface extending upwardly in a second direction, opposite to said first direction, at a second predetermined angle with respect to said concave seating portion from the other end of said smoothly depressed, concave seating portion of said chair toward the other end of said chair and having a second predetermined length, which is less than said first predetermined length of said first inclined surface, for stably supporting the torso portion of a second infant's body, having a second length dimension, as defined between the buttocks of said second infant and the neck of said second infant, which is smaller in length than said torso portion of said first infant supported upon said first inclined surface, and which is characteristic of an average sized child of up to and including at least one year of age, said first and second inclined surfaces, together with said smoothly depressed, concave seating portion, having a substantially V-shaped configuration.

2. An infant's chair for shampooing according to claim 1, wherein said seating portion and one of said inclined back supporting portions are formed separately of each other.

3. An infant's chair for shampooing according to claim 2, wherein said seating portions and said one of said inclined seating portions are provided with engaging means adapted to permit union and disunion thereof.

4. An infant's chair as set forth in claim 1, further comprising:

another inclined surface portion having means defined therein for permitting said another inclined surface portion to be secured to said base portion so as to cover one of said first and second inclined surface portions in an enveloping manner.

5. An infant's chair as set forth in claim 4, wherein:

the length of said another inclined surface portion is greater than said predetermined length of said one of said first and second inclined surface portions which is enveloped by said another inclined surface portion whereby the effective length of said one of said first and second inclined surface portions is able to be extended.

6. An infant's chair as set forth in claim 1, wherein:

one of said first and second inclined surface portions is a separate piece from said base portion and said other one of said first and second resilient surface portions; and means defined within said one of said first and second inclined surface portions and said base portion for permitting connection and disconnection of said one of said first and second inclined surface portions from said base portion whereby said one of said first and second inclined surface portions may be replaced by another inclined surface portion.

7. An infant's chair as set forth in claim 6, wherein:

said another inclined surface portion has a predetermined length which is different than said predetermined length of said one of said first and second inclined surface portions.

8. An infant's chair as set forth in claim 6, wherein:

said one of said first and second inclined surface portions is separable from said base portion along a planar line of separation; and said line of separation is disposed within a vertical plane.

9. An infant's chair as set forth in claim 6, wherein:

said one of said first and second inclined surface portions is separable from said base portion along a planar line of separation; and said line of separation is disposed within a horizontal plane.

10. An infant's chair as set forth in claim 6, wherein:

said one of said first and second inclined surfaces portions is separable from said base portion along a planar line of separation; and said line of separation is disposed within an inclined plane.

11. An infant's chair as set forth in claim 1, wherein:

said base portion and said first and second inclined surface portions are fabricated from a foam plastic.

12. An infant's chair as set forth in claim 11, wherein:

said base portion and said first and second inclined surface portions are fabricated as solid foam structures.

13. An infant's chair as set forth in claim 11, wherein:

said base portion and said first and second inclined surface portions are fabricated as hollow shell structures.

* * * * *